US006021934A

United States Patent [19]

Ho

[11] Patent Number: 6,021,934

[45] Date of Patent: Feb. 8, 2000

[54] CLOTHES HANGER

[76] Inventor: Chan Hsiang Ho, P.O. Box 24-108, Taipei, Taiwan

[21] Appl. No.: 09/343,501

[22] Filed: Jun. 30, 1999

[51] Int. Cl.[7] ..... A47G 25/30; A47G 25/14

[52] U.S. Cl. ..... 223/98; 223/85

[58] Field of Search ..... 223/98, 85, 92, 223/88

[56] References Cited

U.S. PATENT DOCUMENTS

| | | | |
|---|---|---|---|
| D. 32,688 | 5/1900 | Heimann | 223/85 |
| 881,277 | 3/1908 | Acheson | 223/85 |
| 964,003 | 7/1910 | Douglas | 223/85 |
| 3,237,820 | 3/1966 | Evans | 223/85 |
| 4,058,241 | 11/1977 | Craig | 223/98 |
| 4,586,637 | 5/1986 | Lemel | 223/92 |

*Primary Examiner*—Bibhu Mohanty

[57] ABSTRACT

An improved clothes hanger includes metal wires and plastic bristles. The metal wires are intertwined and spiralled into the shape of a clothes hanger having two shoulder portions. The bristles are twined with the metal wires such that they are located at and project elastically from the shoulder portions of the clothes hanger. When a piece of clothing is hung on the clothes hanger, the bristles support and match the curvature of the shoulders of the clothing, thus preventing wrinkling of the shoulders of the clothing.

1 Claim, 2 Drawing Sheets

CLOTHES HANGER

BACKGROUND OF THE INVENTION (a) Field of the Invention

The present invention relates to an improved clothes hanger, more particularly to a clothes hanger that can prevent wrinkling of shoulders of clothes hung thereon.

(b) Description of the Prior Art

Clothes hangers are indispensable household items. Conventional clothes hangers are generally formed by bending a metal wire or molded from plastics. Clothes hung on the conventional clothes hanger can easily become wrinkled because the shoulders of a coat, for instance, are directly supported by relatively rigid shoulder portions of the clothes hanger. After a period of time, due to concentration of forces on the shoulder portions of the clothes hanger, the shoulders of the coat will become wrinkled or even deform in shape. Although there is available a type of clothes hanger provided with plastic curved shoulder pads to try to eliminate the above-mentioned drawback, they are not economical and the shoulder pads can be adapted for use on clothes hangers of special specifications. Besides, the shoulder pads may displace and may be misplaced after taken down from the clothes hanger.

SUMMARY OF THE INVENTION

A primary object of the present invention is to provide an improved clothes hanger to prevent wrinkling of shoulders of clothes hung thereon and eliminate the drawbacks of the prior art. Another object of the present invention is to provide an improved clothes hanger that can be mass-produced at a low cost.

In order to achieve the above-mentioned objects, a preferred embodiment of an improved clothes hanger of the present invention includes a plurality of metal wires that can be wrapped in a plastic film; and plastic bristles that are soft and have certain elasticity. The metal wires are intertwined and spiralled, and are bent into shape of a clothes hanger having two shoulder portions. The bristles are twined with the metal wires such that they are located at and projecting elastically from the shoulder portions. When a piece of clothing is hung on the clothes hanger, its shoulders will not easily become wrinkled. The drawbacks of the prior art are thus eliminated.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
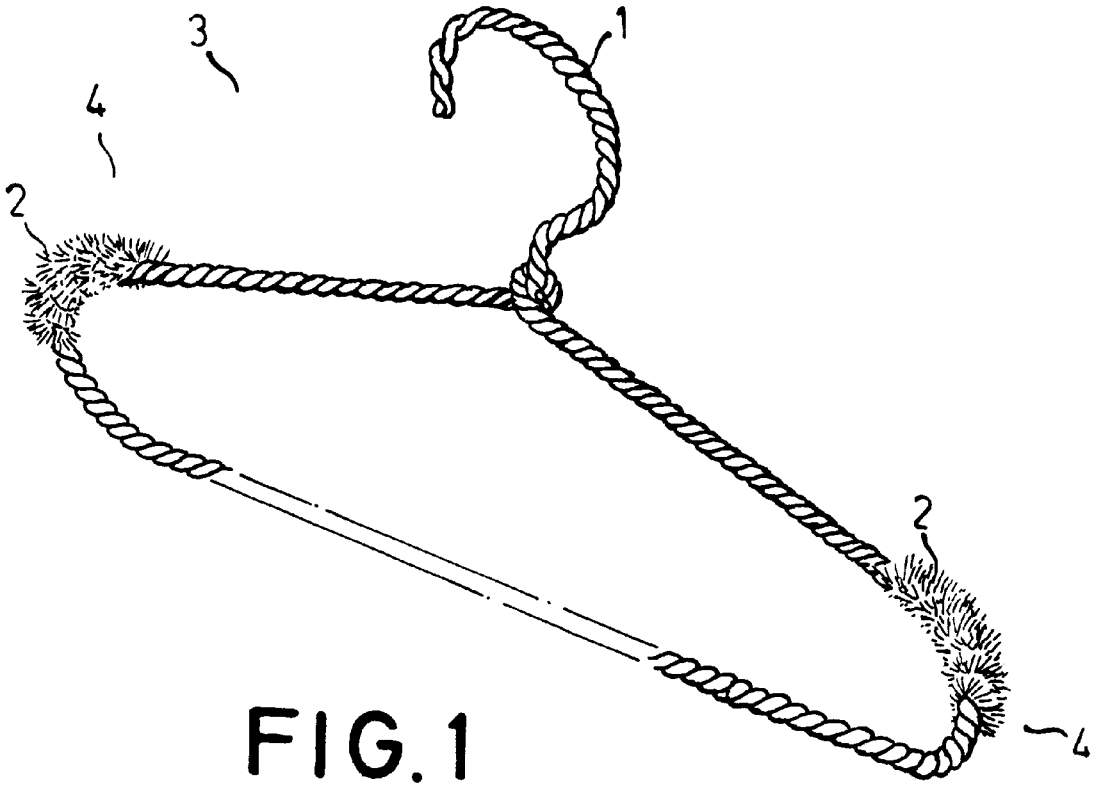
FIG. 1 is a perspective view of a preferred embodiment of the present invention.
Figure 2:
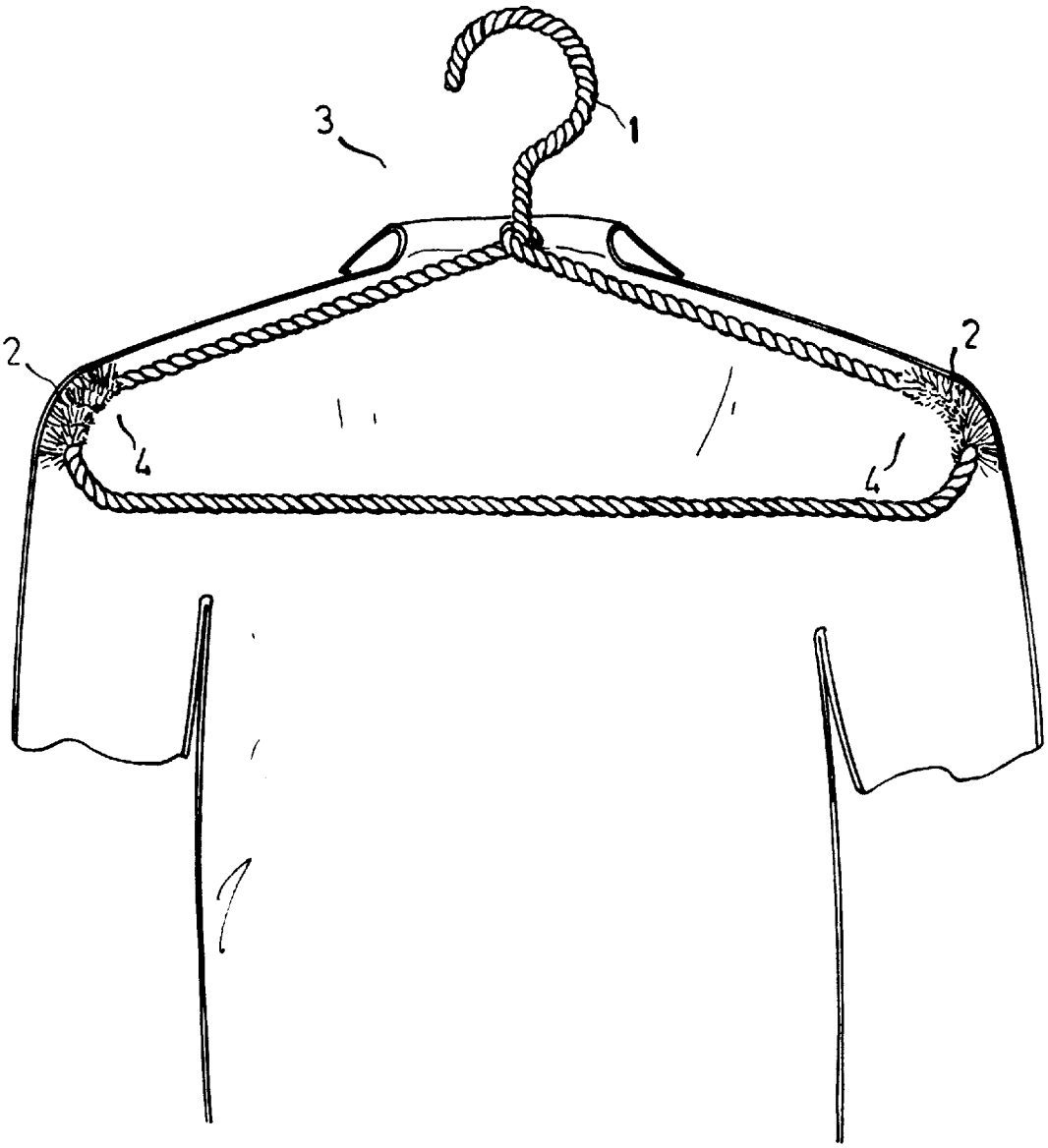
FIG. 2 is a side sectional schematic view of the preferred embodiment in use.

With reference to FIGS. 1–2, the present invention is shown to include a plurality of metal wires 1 and plastic bristles 2. The metal wires 1 are wrapped in a plastic film. The plastic bristles 2 are soft and have certain elasticity. Automated machinery is used to intertwine and spiral the metal wires 1 and bend the intertwined and spiralled metal wires 1 into the shape of a clothes hanger 3 having two shoulder portions 4. During intertwining of the metal wires 1, the plastic bristles 2 are also twined therewith such that they are located at and elastically project from the shoulder portions 4 of the clothes hanger 3.

In actual use, after a piece of clothing, such as a coat, is hung on the clothes hanger 3, the plastic bristles 2, soft but having a certain elasticity, on the shoulder portions 4 will support the shoulders of the coat to prevent them from contacting metal wires 1 and to maintain the curved contour of the shoulders of the coat. Hence, the coat will not easily become wrinkled or deform in shape due to concentration of forces on the shoulder portions 4. The drawbacks with the prior art are also obviated. Furthermore, the clothes hanger of the present invention can be mass-produced at a low cost using automated machinery Although the present invention has been illustrated and described with reference to the preferred embodiment thereof, it should be understood that it is in no way limited to the details of such embodiment but is capable of numerous modifications within the scope of the appended claims.

What is claimed is:

1. An improved clothes hanger, comprising:

a plurality of metal wires that can be wrapped in a plastic film; and plastic bristles that are soft and have a certain elasticity, wherein said metal wires are intertwined and spiralled, and are bent into shape of a clothes hanger having two shoulder portions, said plastic bristles being twined with said metal wires such that they are located at and projecting elastically from said shoulder portions, whereby shoulders of a piece of clothing hung on said clothes hanger can be prevented from being wrinkled.

* * * * *